US008088047B2

(12) United States Patent
Marji

(10) Patent No.: US 8,088,047 B2
(45) Date of Patent: Jan. 3, 2012

(54) EXERCISE DEVICE AND METHOD OF JUMP ROPE EXERCISE USING TWO SEPARATE ROPES

(76) Inventor: Ghassan Marji, Yonkers, NY (US)

( * ) Notice: Subject to any disclaimer, the term of this patent is extended or adjusted under 35 U.S.C. 154(b) by 0 days.

(21) Appl. No.: 12/287,491

(22) Filed: Oct. 10, 2008

(65) Prior Publication Data

US 2010/0093502 A1 Apr. 15, 2010

(51) Int. Cl.
*A63B 5/20* (2006.01)

(52) U.S. Cl. ..... 482/82

(58) Field of Classification Search ..... 482/81–82, 482/35–37; 182/190, 196
See application file for complete search history.

(56) References Cited

U.S. PATENT DOCUMENTS

| | | | | |
|---|---|---|---|---|
| 4,787,623 | A * | 11/1988 | Cedar | 482/81 |
| 5,895,341 | A * | 4/1999 | Jones | 482/81 |
| 6,544,149 | B2 * | 4/2003 | O'Shea | 482/82 |
| 6,887,188 | B1 * | 5/2005 | Davies | 482/82 |
| 2001/0011054 | A1 * | 8/2001 | O'Shea | 482/82 |
| 2004/0002408 | A1 * | 1/2004 | Rigas | 482/82 |
| 2005/0266965 | A1 * | 12/2005 | Foxman | 482/82 |
| 2007/0191195 | A1 * | 8/2007 | St. George et al. | 482/82 |

* cited by examiner

*Primary Examiner* — Fenn Mathew

(57) ABSTRACT

A jump rope exercise device is provided having a first elongated member and a second elongated member with each member having a free distal end, and a proximal end rotatably attached to a specially designed handle which can be gripped between the fingers of the user during the exercise period. During the exercise each handle is gripped by the user; one by the left hand and the other by the right hand, and the elongated members are maneuvered in clockwise, counterclockwise or crisscrossing direction.

3 Claims, 4 Drawing Sheets

EXERCISE DEVICE AND METHOD OF JUMP ROPE EXERCISE USING TWO SEPARATE ROPES

FIELD OF THE INVENTION

This invention relates generally to jump rope exercise device and method and is particularly related to such exercise device and method in which the exerciser uses two separate ropes, one in each hand, during the entire exercise period.

BACKGROUND OF THE INVENTION

Jumping rope is a well known cardiovascular exercise for fitness, increased endurance and improved coordination. Typically, a jump rope consists of an elongated cord extending between a pair of handles as shown, for example, in U.S. Pat. No. 6,422,978 issued Jul. 23, 2002 to Ronald D. Bouvier. In this patent the cord has a pair of end portion each connected to a handle, and an intermediate portion which is thicker than the other portions to provide a heavier intermediate portion. The exercise rope described in said patent is a variation of the conventional rope which has a uniform thickness from end to end. It is a matter of common experience, however, that jumping rope exercise using conventional ropes familiar to exercisers can cause tripping and lack of coordination thus requiring skill to prevent tripping and injury. A recent publication, i.e., Pub. No. US 2005/0266965 A1 describes an exercise device which includes a first member and a second member, both of which are made from a non-elastic material, a first handle rotatably coupled to one end of the first member, and a second handle rotatably coupled to the end of the second member. Each of the handles is slidable along its respective member between the ends of that member, with the handles remaining in slidable contact with their respective members. A handle stop is coupled to the respective ends of said members for maintaining the handles in slidable contact with each member.

Several other patents describe different types of handles for attachment to the ends of a conventional type jumping ropes. For example, U.S. Pat. No. 5,662,561 issued Sep. 2, 1997 to Thomas McNamara descries a pair of weighted handles at the ends of the jump rope. Another patent, i.e., U.S. Pat. No. 4,787,624 issued Nov. 27, 1988 to Jeremy A. Grant described a jump rope with hand weight attachment, and U.S. Pat. No. 4,593,899 issued Jun. 10, 1986 to Robert A. Miller discloses a jump rope provided with resiliently flexible handles for changing the force exerted on the user during swinging of the ropes.

Notwithstanding the efforts of the prior art workers the conventional rope exercise method today, as in the past, involves the use of an exercise rope such as the rope described in said U.S. Pat. No. 6,422,978 B2 and variations thereof using different types of handles to facilitate the use of the rope by the user.

Therefore, it is an object of the present invention to provide an exercise device using separate jump ropes, and a method of using such exercise device.

It is also an object of this invention to provide a jump rope device and a jump rope exercise method which can be used by the user without the difficulties or problems which are encountered during jump rope exercise using conventionally known jump rope devices.

It is a specific object of the present invention to provide a jump rope device and jump rope exercise method wherein the user uses a single rope in each hand, one in the right hand and another in the left hand, during the entire exercise period.

The foregoing and other objects of the present invention will be more clearly understood and appreciated from the following detailed description of the invention taken in conjunction with the drawings in this application.

SUMMARY OF THE INVENTION

This invention provides a jump rope exercise device and an exercise method using a single rope in each hand during the exercise. The device comprises a first elongated member and a second elongated member, each of said members having a free distal end and a proximal end. Each of the proximal ends is rotatably coupled to a specially designed handle which can be gripped by the user to rotate the rope in clockwise and counterclockwise direction during the exercise. Each of the handles is generally T-shaped and comprises a body portion having a generally bell-shaped top portion and an inverted generally bell-shaped top portion. Each side of the top portion has an aperture which is aligned with the aperture in the other side with a cross piece defining the transverse portion of the T-shaped body passing through said apertures. The hollow bottom portion has an opening for passage of the elongated member partially into said hollow body. The end of the elongated member in said bottom portion is provided with a cross piece which is sized to prevent the rope from being pulled out of the handle.

During the exercise, the user grips each handle between two fingers of each hand and each elongated member is maneuvered clockwise, counterclockwise or in criss-crossing motion without the risk of tripping as is encountered in conventional jump rope exercise methods.

BRIEF DESCRIPTION OF THE DRAWINGS

In the drawings wherein like reference numerals are employed to designate like parts wherever possible.

DETAILED DESCRIPTION OF THE INVENTION

Figure 1:
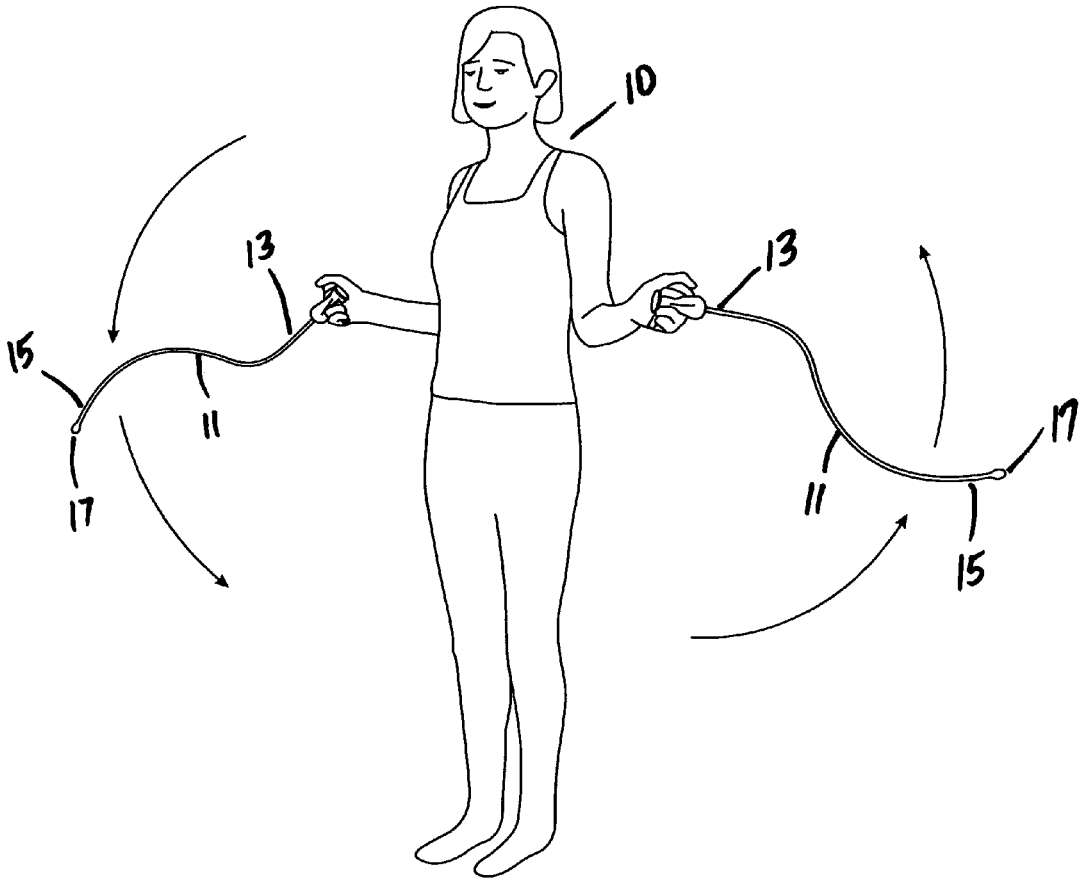
FIG. 1 is a view of a person exercising with a jump rope according to the present invention using two single ropes, one in each hand.

Referring to the drawings, FIG. 1 shows an exerciser 10 holding an exercise device in each hand for exercise according to the method of this invention. The exercise device includes a pair of elongated members 11, each elongated member being generally the same length, usually made of a non-elastic material and is in the form of jump rope with which the users are well familiar. Thus, the terms elongated member and rope are hereinafter used synonymously.

Each elongated member M may be fabricated from various resilient materials such as, e.g., nylon, polyester and polypropylene. The length and diameter of each elongated are usually the same and may be tailored to suit the exercise.

The exercise device in each hand has the same construction having a proximal; end 13 and a distal end 15. Each distal end 15 terminates into a bulbous form member 17 to facilitate and insure smooth rotation of the rope during the exercise. The proximal end of each ropes may be secured to a handle such as 19 as in FIG. 3, or handle 21 in FIG. 2, however and in accordance with the exercise device of the present invention, the proximal ends of each elongated member is secured to a specially constructed handle 21 as shown in FIG. 2.

Figure 2:
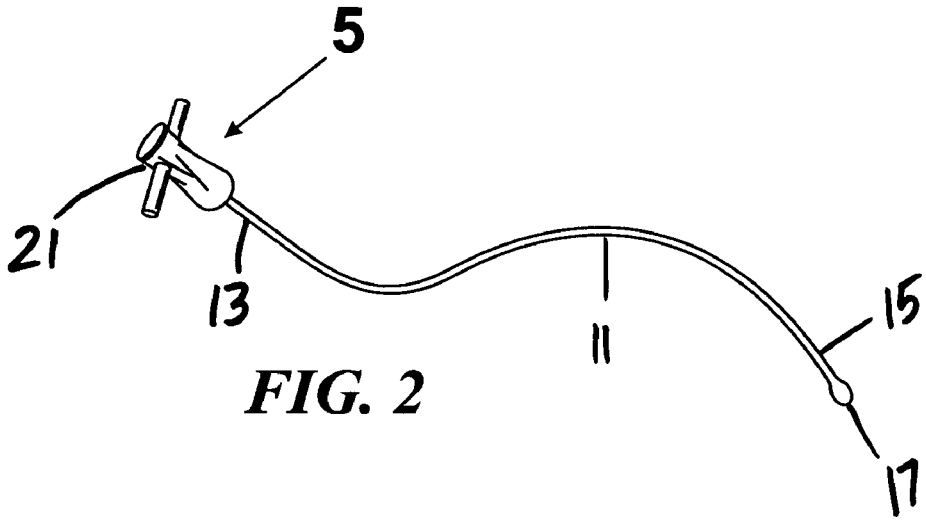
FIG. 2 is a view of an exercise device of the present invention consisting of a single rope attached to a handle.
Figure 3:
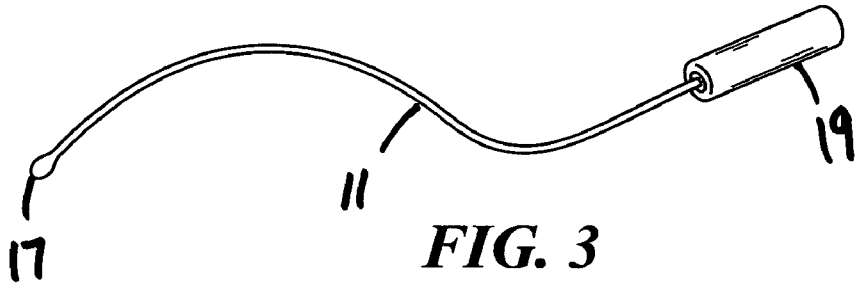
FIG. 3 is a view of an exercise device of the present invention consisting of a single rope attached to a handle different from the handle shown FIG. 2.
Figure 4:
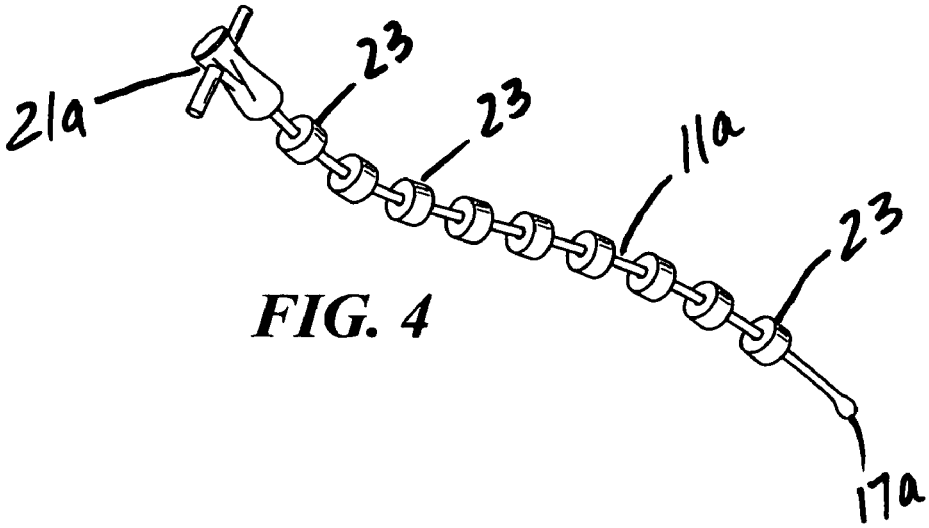
FIG. 4 is a view of an exercise device of the present invention consisting of a weighted rope with attached handle similar to FIG. 2.

FIG. 4 shows another exercise device of the present invention including an elongated member 11*a* having a bulbous distal end 17 as in FIGS. 2 and 3 and a proximal end secured to a handle 21*a* similar to the handle 21 in FIG. 2. The rope shown in FIG. 4 is weighted by passing the rope through a plurality of spaced apart rings 23 to increase the weight of the rope thus requiring greater strength to rotate the rope during the exercise.

Figure 5:
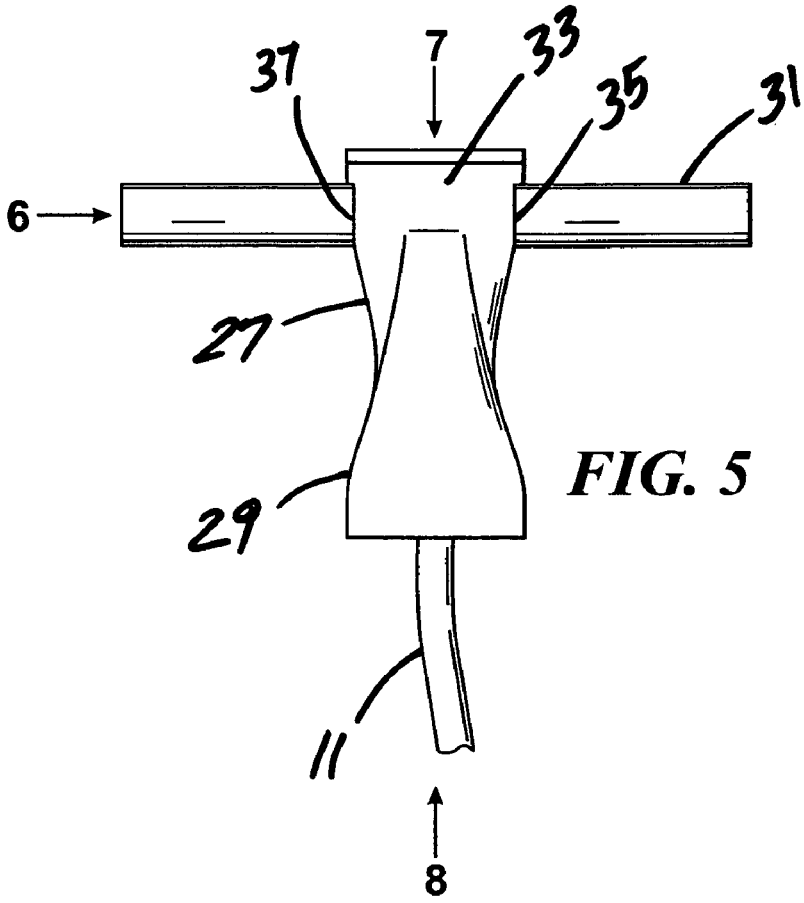
FIG. 5 is a front view of the handle shown in FIG. 2.
Figure 6:
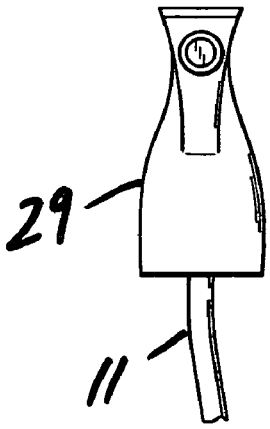
FIG. 6 is a side view of the handle shown in FIG. 5 looking at the direction of the arrow in FIG. 5.
Figure 7:
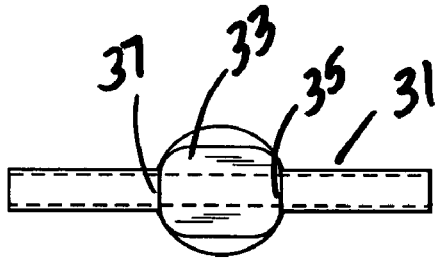
FIG. 7 is a top view of the handle shown in FIG. 5 looking at the direction of the arrow 7 in FIG. 5.
Figure 8:
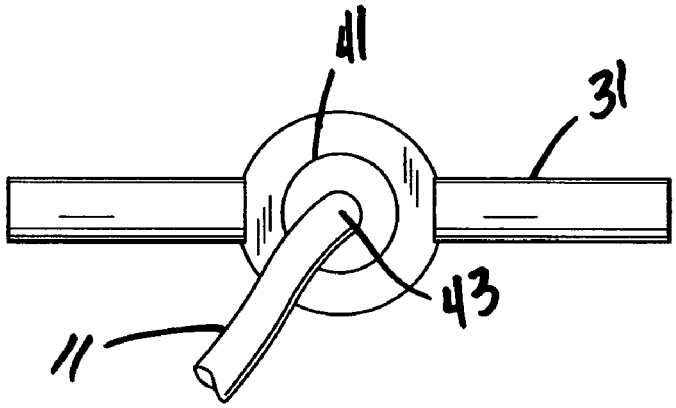
FIG. 8 is a bottom view of the handle shown in the direction of the arrow 8 in FIG. 5.
Figure 9:
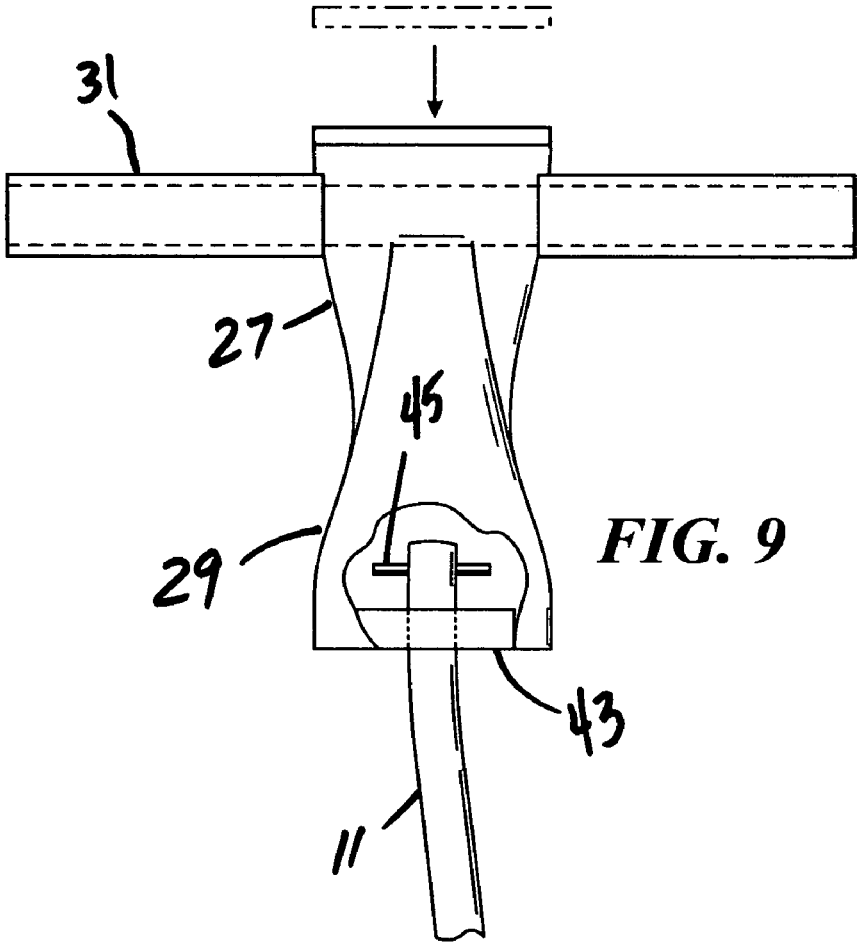
FIG. 9 is a front view of the handle shown in FIG. 5, partly cut away to show the end of the rope within the handle.

The jump rope exercise is facilitated using a single rope in each hand and rotating each rope in the direction of the arrows shown in FIG. 1. The rotation may be clockwise or counterclockwise while each rope is rotatably secured to or within a specially designed handle as the handle 21 in FIGS. 2 and 4. Referring to FIG. 5, the handle 21 is shown in a generally T-shaped configuration defined by a vertical hollow body member 25 formed, as by molding, as a generally bell-shaped open top portion 27 and an inverted generally bell-shaped bottom portion 29, and a crosspiece 31. The top portion 27 is open at its top such as at 33 shown in FIG. 7 and includes a pair of opposed apertures 35,37 through which the crosspiece 31 extends from one side of the top portion to the other side of the top portion. The crosspiece 31 is conveniently sized so it can be conveniently gripped by the exerciser between the forefinger and the middle finger while rotating the rope. As seen from FIGS. 8 and 9 the bottom 39 of the bell body portion 29 is closed partly by the ring member 41 which has a central aperture 43 sized to permit the passage of the exercise rope 11 which terminates in a crosspiece 45 sized to prevent the exercise rope from exiting through the top opening 33.

The exercise device of this invention permits more diverse jump rope exercising capability. In conventional jump rope exercise the end of the rope is gripped by different hands of the exercise and the rope is rotated either in clockwise or counterclockwise direction, with the rope passed below the first while the exercise jump over the rope. The exercise device of this invention permits the exerciser to grip our rope in each hand and both ropes can be rotated in clockwise or counterclockwise direction, or one rope can be rotated in clockwise direction while the other rope is simultaneously rotated in a counterclockwise direction. In either mode, the exerciser need not jump over the rope therefore eliminating tripping over the rope as in experienced with conventional jump rope exercise.

It can be appreciated from the foregoing description that the exercise device of this invention offers the user all the cardiovascular exercise and endurance realized with conventional rope jumping methods without risk of injury, especially inexperienced jump rope exercisers. In can also be appreciated that some changes may be made in the exercise device herein described which are obvious from the detailed description of the invention and the drawings. Such changes are nevertheless contemplated by and are within the scope of this invention.

The invention claimed is:

1. A jump rope exercising device comprising:

(a) a first elongated member fabricated from a non-elastic material;

(b) a second elongated member fabricated from a non-elastic material;

(c) each of said first non-elastic and second non-elastic members having a free distal end, and a proximal end;

(d) each of said proximal ends being rotatably coupled to a handle, said handle adapted to be gripped between fingers of a user of said exercise device to rotate each respective elongated member; and (e) wherein each of said handles is generally T-shaped in configuration comprising a body portion having a generally bell-shaped hollow top portion and an inverted generally bell shaped hollow bottom portion, said top portion defined by sides having opposed apertures for passage of a cross piece defining the transverse member of said T-shaped body, said bottom portion having an opening for passage of the elongated member through said opening partially therein.

2. A jump rope exercise device as in claim 1 wherein said elongated member is weighted by inserting said elongated member through a plurality of ring members spaced apart along substantial length of said elongated member.

3. A method of jump rope exercise using the device of claim 1, said method comprising grasping the handle of the first elongated member by the left hand of the exerciser, grasping the handle of the second elongated member by the right hand, rotating each of said elongated members, one in clockwise direction and the other in counterclockwise direction.

* * * * *